US009913065B2

(12) United States Patent
Vautin et al.

(10) Patent No.: US 9,913,065 B2
(45) Date of Patent: Mar. 6, 2018

(54) SIMULATING ACOUSTIC OUTPUT AT A LOCATION CORRESPONDING TO SOURCE POSITION DATA

(71) Applicant: Bose Corporation, Framingham, MA (US)

(72) Inventors: Jeffery R. Vautin, Worcester, MA (US); Michael S. Dublin, Arlington, MA (US); Charles Oswald, Arlington, MA (US)

(73) Assignee: Bose Corporation, Framingham, MA (US)

( * ) Notice: Subject to any disclaimer, the term of this patent is extended or adjusted under 35 U.S.C. 154(b) by 32 days.

(21) Appl. No.: 14/946,951

(22) Filed: Nov. 20, 2015

(65) Prior Publication Data

US 2017/0013386 A1 Jan. 12, 2017

Related U.S. Application Data

(63) Continuation-in-part of application No. 14/828,991, filed on Aug. 18, 2015, and a continuation-in-part of application No. 14/791,758, filed on Jul. 6, 2015.

(51) Int. Cl.
*H04R 5/00* (2006.01)
*H04S 5/00* (2006.01)
(Continued)

(52) U.S. Cl.
CPC ..... *H04S 5/00* (2013.01); *H04R 5/023* (2013.01); *H04S 3/008* (2013.01); *H04S 7/30* (2013.01);
(Continued)

(58) Field of Classification Search
CPC ... H04S 5/00; H04S 3/008; H04S 7/30; H04S 7/302; H04S 2400/11; H04S 2420/01; H04S 2499/13; H04R 5/023; H04R 2499/13
See application file for complete search history.

(56) References Cited

U.S. PATENT DOCUMENTS 6,577,738 B2 6/2003 Norris et al.
6,778,073 B2 8/2004 Lutter et al.
(Continued)

FOREIGN PATENT DOCUMENTS

EP 1858296 A1 11/2007
EP 2445759 A2 5/2012
(Continued)

OTHER PUBLICATIONS

Invitation to Pay Additional Fees dated Nov. 7, 2016 for PCT/US2016/046660.
(Continued)

*Primary Examiner* — Andrew L Sniezek
(74) *Attorney, Agent, or Firm* — Bose Corporation

(57) ABSTRACT

An audio system includes a plurality of speakers and an audio signal processor. The audio signal processor receives an audio signal and source position data associated with the audio signal; and applies a set of speaker driver signals to the plurality of speakers. The set of speaker driver signals causes the plurality of speakers to generate acoustic output that simulates output of the audio signal by an audio source at a location corresponding to the source position data in each of a plurality of discrete acoustic areas.

18 Claims, 11 Drawing Sheets

(51) Int. Cl.
*H04S 3/00* (2006.01)
*H04R 5/02* (2006.01)
*H04S 7/00* (2006.01)

(52) U.S. Cl.
CPC ..... *H04R 2499/13* (2013.01); *H04S 7/302* (2013.01); *H04S 2400/11* (2013.01); *H04S 2420/01* (2013.01)

(56) References Cited

U.S. PATENT DOCUMENTS

| | | | |
|---|---|---|---|
| 7,630,500 | B1 | 12/2009 | Beckman et al. |
| 7,792,674 | B2 | 9/2010 | Dalton, Jr. et al. |
| 8,218,783 | B2 | 7/2012 | Katzer et al. |
| 8,325,936 | B2 | 12/2012 | Eichfeld et al. |
| 8,483,413 | B2 | 7/2013 | Hartung et al. |
| 8,724,827 | B2 | 5/2014 | Hartung et al. |
| 9,049,534 | B2 | 6/2015 | Eichfeld et al. |
| 9,100,748 | B2 | 8/2015 | Hartung et al. |
| 9,100,749 | B2 | 8/2015 | Hartung et al. |
| 9,167,344 | B2 | 10/2015 | Choueiri |
| 9,338,554 | B2 | 5/2016 | Christoph |
| 9,357,304 | B2 | 5/2016 | Christoph |
| 2003/0142835 | A1 | 7/2003 | Enya et al. |
| 2004/0196982 | A1 | 10/2004 | Aylward et al. |
| 2005/0213528 | A1 | 9/2005 | Aarts et al. |
| 2006/0045294 | A1 | 3/2006 | Smyth |
| 2007/0006081 | A1 | 1/2007 | Maehata et al. |
| 2007/0053532 | A1 | 3/2007 | Elliott et al. |
| 2008/0273722 | A1 | 11/2008 | Aylward et al. |
| 2010/0158263 | A1 | 6/2010 | Katzer et al. |
| 2013/0136281 | A1 | 5/2013 | Steffens et al. |
| 2013/0177187 | A1 | 7/2013 | Mentz |
| 2013/0178967 | A1 | 7/2013 | Mentz |
| 2014/0119581 | A1 | 5/2014 | Tsingos et al. |
| 2014/0133658 | A1 | 5/2014 | Mentz et al. |
| 2014/0133672 | A1 | 5/2014 | Lakkundi et al. |
| 2014/0334637 | A1 | 11/2014 | Oswald et al. |
| 2014/0334638 | A1 | 11/2014 | Barksdale et al. |
| 2014/0348354 | A1 | 11/2014 | Christoph et al. |
| 2015/0242953 | A1 | 8/2015 | Suiter |
| 2016/0142852 | A1 | 5/2016 | Christoph |
| 2016/0205473 | A1* | 7/2016 | Rodigast ..... H04R 1/403 381/303 |
| 2017/0013385 | A1* | 1/2017 | Vautin ..... H04R 1/323 |

FOREIGN PATENT DOCUMENTS

| | | | |
|---|---|---|---|
| EP | 2816824 | A2 | 12/2014 |
| WO | 2009012496 | A2 | 1/2009 |
| WO | 2012/141057 | A1 | 10/2012 |
| WO | 2014035728 | A2 | 3/2014 |
| WO | 2014043501 | A1 | 3/2014 |
| WO | 2014159272 | A1 | 10/2014 |

OTHER PUBLICATIONS

International Search Report and Written Opinion dated Oct. 7, 2016 for PCT/US2016/040270.

International Search Report and Written Opinion dated Oct. 6, 2016 for PCT/US2016/040285.

International Search Report and Written Opinion dated Mar. 16, 2017 for PCT/US2016/046660.

* cited by examiner

SIMULATING ACOUSTIC OUTPUT AT A LOCATION CORRESPONDING TO SOURCE POSITION DATA

CROSS-REFERENCE TO RELATED APPLICATIONS

This application is a continuation-in-part of U.S. application Ser. No. 14/791,758, filed Jul. 6, 2015. This application is also a continuation-in-part of U.S. application Ser. No. 14/828,991, filed Aug. 18, 2015. The contents of U.S. application Ser. Nos. 14/791,758 and 14/828,991 are incorporated herein by reference.

BACKGROUND

This disclosure generally relates to simulating acoustic output, and, more particularly, to simulating acoustic output at a location corresponding to source position data in each of a plurality of discrete acoustic areas.

SUMMARY

All examples and features mentioned below can be combined in any technically possible way.

In one aspect, an audio system includes a plurality of speaker and an audio signal processor. The audio signal processor receives an audio signal and source position data associated with the audio signal; and applies a set of speaker driver signals to the plurality of speakers. The set of speaker driver signals causes the plurality of speakers to generate acoustic output that simulates output of the audio signal by an audio source at a location corresponding to the source position data in each of a plurality of discrete acoustic areas.

Implementations may include one of the following features, or any combination thereof.

In some implementations, the audio signal processor is configured to receive user input indicating engagement of a privacy mode, and, in response, halt the simulation of output of the audio signal in a first one of the acoustic areas.

In certain implementations, in response to receiving the user input indicating engagement of the privacy mode, the audio signal processor is configured to override the received source position data with predetermined position data, such that output of the audio signal is simulated at a location corresponding to the predetermined position data in a second one of the acoustic areas.

In some cases, the predetermined position data corresponds to a location in the second one of the acoustic areas in which crosstalk is substantially attenuated relative to the first one of the acoustic areas.

In certain cases, the audio signal processor is configured to provide for crosstalk cancellation filtering of the speaker driver signals for crosstalk cancellation between the first and second ones of the acoustic areas.

In some examples, the audio signal processor is further configured to filter a subset of the speaker driver signals via a plurality of cross-talk cancellation filters before the subset of speaker driver signals are applied to a corresponding subset of the speakers, thereby to inhibit cross-talk of acoustic energy between the plurality of acoustic areas.

In certain examples, the plurality of speakers include a first plurality of near-field speakers arranged in a first one of the acoustic areas, and a second plurality of near-field speakers arranged in a second one of the acoustic areas. The plurality of speakers also include a plurality of other fixed speakers. The audio system is configured such that acoustic energy from the first plurality of near-field speakers combines with acoustic energy from the other fixed speakers to simulate output of the audio signal by an audio source at a location corresponding to the source position data in the first one of the acoustic areas, and such that acoustic energy from the second plurality of near-field speakers combines with acoustic energy from the other fixed speakers to simulate output of the audio signal by an audio source at a location corresponding to the source position data in the second one of the acoustic areas.

In some implementations, the audio system includes a plurality of headrests, and the near-field speakers are mounted in the headrests.

In certain implementations, the plurality of speakers and the audio signal processor are included in a vehicle.

In another aspect, a method includes receiving an audio signal and source position data associated with the audio signal; and applying a set of speaker driver signals to a plurality of speakers. The set of speaker driver signals causes the plurality of speakers to generate acoustic output that simulates output of the audio signal by an audio source at a location corresponding to the source position data in each of a plurality of discrete acoustic areas.

Implementations may include one of the above and/or below features, or any combination thereof.

In some implementations, the set of speaker driver signals correspond to one or more fixed speakers, one or more virtual speakers, or a combination thereof.

In certain implementations, the set of speaker driver signals corresponding to a plurality fixed speakers and a plurality of virtual speakers.

In some cases, a first subset of the speaker driver signals is transduced via the plurality of fixed speakers and a second subset of speaker driver signals is transduced via a first set of the virtual speakers, such that acoustic energy from the first set of the virtual speakers combines with acoustic energy from the plurality of fixed speakers to simulate output of the audio signal by an audio source at a location corresponding to the source position data in a first one of the acoustic areas. A third subset of speaker driver signals is transduced via a second set of the virtual speakers, such that acoustic energy from the second set of the virtual speakers combines with acoustic energy from the plurality of fixed speakers to simulate output of the audio signal by an audio source at a location corresponding to the source position data in a second one of the acoustic areas.

In certain cases, input indicating engagement of a privacy mode is received, and, in response, the simulation of output of the audio signal is halted in a first one of the plurality of acoustic areas.

In some examples, halting the simulation of output of the audio signal in a first one of the plurality of acoustic comprises ceasing to apply a subset of the speaker driver signals to the plurality of speakers.

In certain examples, in response to receiving the input indicating engagement of the privacy mode, the received source position data is overridden with predetermined position data, such that output of the audio signal is simulated at a location corresponding to the predetermined position data in a second one of the acoustic areas.

Another aspect features a machine-readable storage medium having instructions stored thereon to simulate acoustic output. The instruction, when executed by a processor, cause the processor to: receive an audio signal and source position data associated with the audio signal; and apply a set of speaker driver signals to a plurality of speakers. The set of speaker driver signals causes the plurality of speakers to generate acoustic output that simulates output of the audio signal by an audio source at a location corresponding to the source position data in each of a plurality of discrete acoustic areas.

Implementations may include one of the above features, or any combination thereof.

According to yet another aspect, an audio amplifier includes a processor and a machine-readable storage medium. The machine-readable storage medium has instructions stored thereon to simulate acoustic output, which, when executed by the processor, cause the processor to receive an audio signal and source position data associated with the audio signal; and apply a set of speaker driver signals to a plurality of speakers. The set of speaker driver signals causes the plurality of speakers to generate acoustic output that simulates output of the audio signal by an audio source at a location corresponding to the source position data in each of a plurality of discrete acoustic areas.

Implementations may include one of the above features, or any combination thereof.

In some implementations, the processor comprises a digital signal processor.

Figure 1:
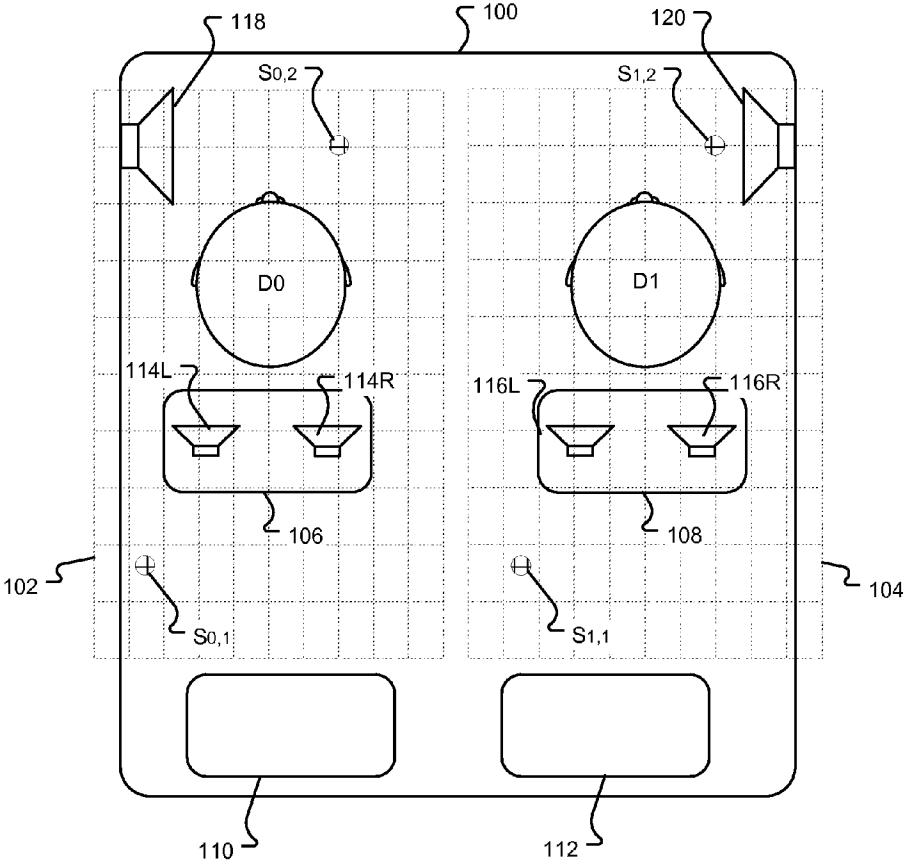
FIG. 1 is an illustrative diagram of a vehicle compartment having an audio system configured to simulate acoustic output at a location corresponding to source position data in each of a plurality of discrete acoustic areas.

Repeat use of reference characters in the present specification and drawings is intended to represent same or analogous features or elements.

DETAILED DESCRIPTION

Though the elements of several views of the drawings herein may be shown and described as discrete elements in a block diagram and may be referred to as "circuitry," unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or digital signal processing techniques and are included within the scope of this patent application. Unless otherwise indicated, audio signals may be encoded in either digital or analog form; conventional digital-to-analog or analog-to-digital converters may not be shown in the figures. For simplicity of wording, "radiating acoustic energy corresponding to the audio signals" in a given channel or from a given array will be referred to as "radiating" the channel from the array.

In selected examples, an audio system dynamically selects and precisely simulates audio (e.g., announcement audio) within a plurality off discrete acoustic areas in an acoustic space (e.g., a vehicle cabin).

FIG. 1 is an illustrative diagram of a vehicle compartment 100 (a/k/a vehicle cabin) having an audio system configured to simulate acoustic output (e.g., announcement audio) separately in each of a plurality of acoustic areas at respective locations corresponding to source position data. Within each acoustic area, the location can be any location inside of an illustrative grid 102, 104. Each grid 102, 104 represents a two-dimensional plane corresponding to an associated one of the acoustic areas. A first grid 102 corresponds to an acoustic area associated with a first seating location, and the second grid 104 corresponding to an acoustic area associated with a second seating location.

The vehicle compartment 100 shown in FIG. 1 includes four seating locations, each represented by a corresponding headrest 106, 108, 110, 112. The two front seating locations 106, 108 are shown to include near-field speakers 114L, 114R, 116L, 116R. In the illustrated example, the near-field speakers consist of headrest mounted speakers.

As shown in FIG. 1, the headrest mounted speakers 114L, 114R (collectively referenced as 114) are positioned near the ears of a listener D0, who in the example of FIG. 1 is the driver of the vehicle. The headrest mounted speakers 114 are operated to control distribution of sound to the ears of the listener D0. The headrest mounted speakers 116L, 116R (collectively referenced as 116) are similarly positioned relative to the ears of a passenger D1, and are operated to control distribution of sound to the ears of the passenger D1.

The vehicle compartment 100 further includes two fixed speakers 118, 120 located on or in the driver side and passenger side doors. In other examples, a greater number of speakers are located in different locations around the vehicle compartment 100. In some examples, each of the individual speakers 114, 116, 118, 120 corresponds to an array of speakers that enables more sophisticated shaping of sound, or more economical use of space and materials to deliver a given sound pressure level. The headrest mounted speakers 114, 116 and the fixed speakers 118, 120 are collectively referred to herein as real speakers, real loudspeakers, fixed speakers, or fixed loudspeakers interchangeably.

Each grid 102, 104 represents a corresponding acoustic area within which any location can be dynamically selected by the audio system to generate acoustic output. In the example of FIG. 1, each grid 102, 104 is a 10×10 coordinate grid that includes one hundred grid points. In other examples, greater or fewer grid points are used to define an acoustic area. Advantageously, in one example, the audio system enables audio projections from any spot within the corresponding acoustic area to the associated listener D0, D1. Moreover, as shown in FIG. 1, each grid 102, 104 includes grid points that are within the vehicle compartment 100 as well as grid points that are outside the vehicle compartment 100. It should therefore be understood that the audio system is capable of simulating acoustic output for locations outside of the vehicle compartment 100.

In FIG. 1, positions $S_{0,1}$ and $S_{1,1}$ illustrate exemplary location positions where sound is shown to be projected. A shown, the experience in both front seating locations is substantially identical. That is, the position of $S_{0,1}$ relative to the driver D0 is substantially the same as the position of $S_{1,1}$ relative the passenger D1. Positions $S_{0,2}$ and $S_{1,2}$ illustrate that the acoustic source may also be simulated at positions forward of the listeners D0, D1. As discussed below, the audio system also utilizes cross-talk cancellation to provide discrete listening experiences at the different seating positions.

Advantageously, in particular examples, the audio system of the present disclosure dynamically selects source positions from which audio output is perceived to be projected in real-time (or near-real-time), such as when prompted by another device or system. Virtual speakers are used in combination with the real speakers to simulate audio energy output to appear to project from these specific and discrete locations.

Figure 2:
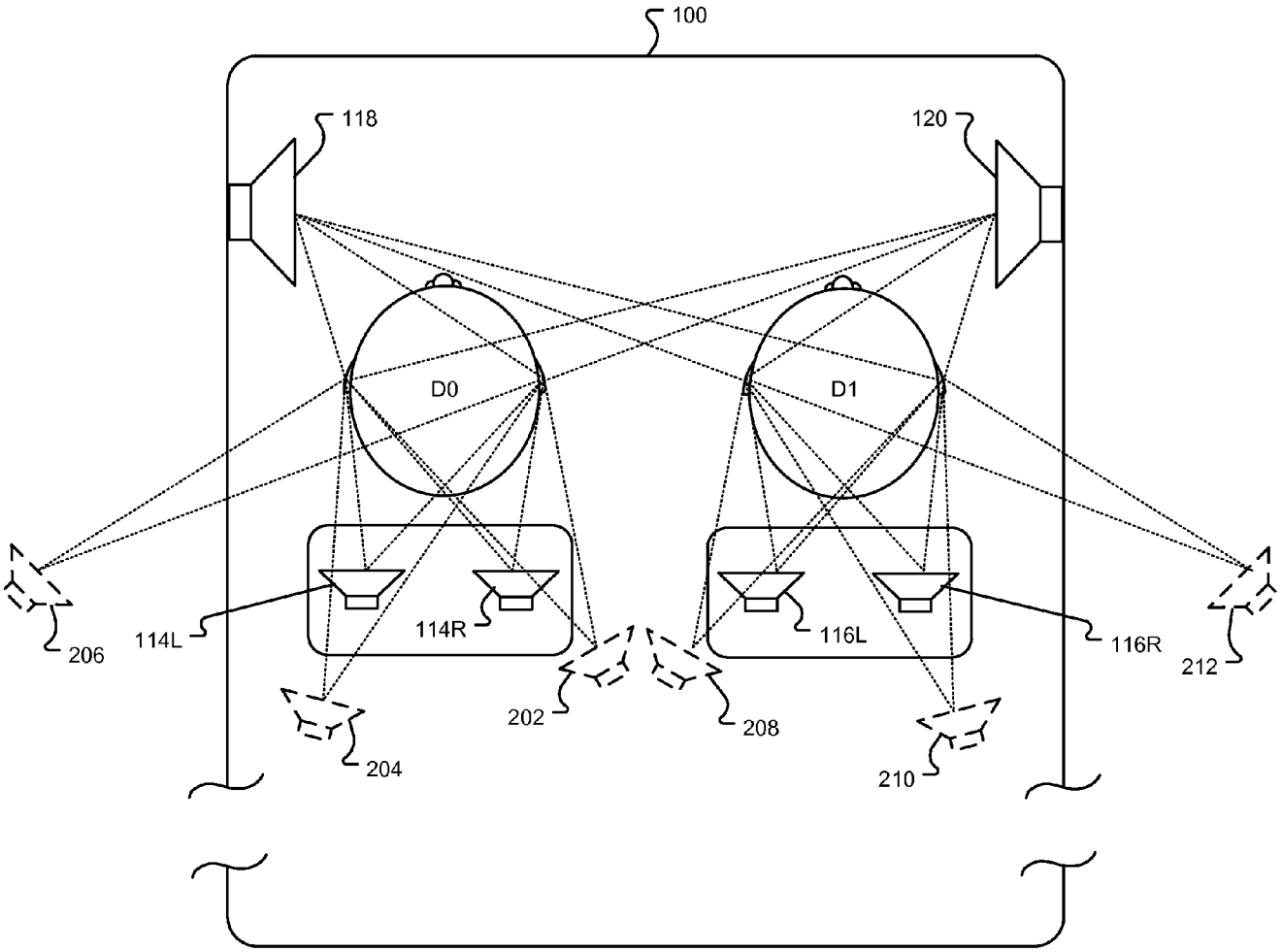
FIG. 2 is an illustrative diagram of speakers of an audio system configured to simulate acoustic output at a location corresponding to source position data in each of a plurality of discrete acoustic areas.

For example, FIG. 2 illustrates real and virtual speakers used by an implementation of the audio system of FIG. 1 to simulate acoustic output at a location corresponding to source position data. In FIG. 2, the real speakers 114, 116, 118, 120 are shown in solid line and virtual speakers 202, 204, 206, 208, 210, 212 are shown in dashed line. The virtual speakers can be "preset" and correspond to speaker locations that are discrete, predefined, and/or static locations where acoustic output is simulated by applying binaural signal filters to an upmixed component of an input audio signal (e.g., audio signal 402 of FIG. 4). In one example, binaural signal filters are utilized to modify the sound played back at the headrest speakers 114, 116 so that the listener (e.g., the driver D0 or passenger D1) perceives the filtered sound as if it is coming from the virtual speakers rather than from the actual (fixed) headrest speakers. In accordance with the techniques of the present disclosure, the virtual speakers also have the ability to precisely simulate acoustic output at a specific location.

As shown in FIG. 2, the left ear and right ear of the listener (e.g., the driver D0 or passenger D1 of FIG. 1) receive acoustic output energy in different amounts from each real and virtual speaker. For example, FIG. 2 includes dotted lines illustrating the different paths that acoustic energy or sound travels from the real speakers and virtual speakers. Notably, as shown in FIG. 2, the virtual speakers can be inside the vehicle compartment (e.g., the virtual speakers 202, 204, 208, 210) as well as outside the vehicle compartment (e.g., the virtual speaker 206, 212). Certain acoustic energy paths for the headrest mounted speakers and virtual speakers of FIG. 2 are omitted to illustrate that cross-talk cancellation, described below, substantially cancels acoustic energy from the driver's headrest speakers 114 and virtual speakers 202, 204, 206 at the passenger's D1 ears, and that acoustic energy from the passenger's headrest speakers 116 and virtual speakers 208, 210, 212 is substantially cancelled at the driver's D0 ears.

It should be noted that, in particular aspects, various signals assigned to each real and virtual speaker are superimposed to create an output signal, and some of the energy from each speaker can travel omnidirectionally (e.g., depending on frequency and speaker design). Accordingly, the dotted lines illustrated in FIG. 2 are to be understood as conceptual illustrations of acoustic energy from different combinations of real and virtual speakers. In examples where speaker arrays or other directional speaker technologies are used, the signals provided to different combinations of speakers provide directional control. Depending on design, such speaker arrays are placed in headrests as shown or in other locations relatively close to the listener, including but not limited to locations in front of the listener.

Each of the listeners D0, D1 hears the real and virtual speakers near his or her head. Acoustic energy from the various real and virtual speakers will differ due to the relative distances between the speakers and the listener's ears, as well as due to differences in angles between the speakers and the listener's ears. Moreover, for some listeners, the anatomy of outer ear structures is not the same for the left and right ears. Human perception of the direction and distance of sound sources is based on a combination of arrival time differences between the ears, signal level differences between the ears, and the particular effect that the listener's anatomy has on sound waves entering the ears from different directions, all of which is also frequency-dependent. The combination of these factors at both ears, for an audio source at a particular x-y location of the grid 102, 104 of FIG. 1, can be represented by a magnitude adjusted linear sum of (e.g., signals corresponding to) the four closest grid points to the audio source on the grid 102, 104. For example, binaural and/or transducing signal filters (or other signal processing operations) are used to shape sound that will be reproduced at the speakers to cause the sound to be perceived as if it originated at the particular x-y location of the grid 102, 104, as further described with reference to FIG. 3.

Figure 3:
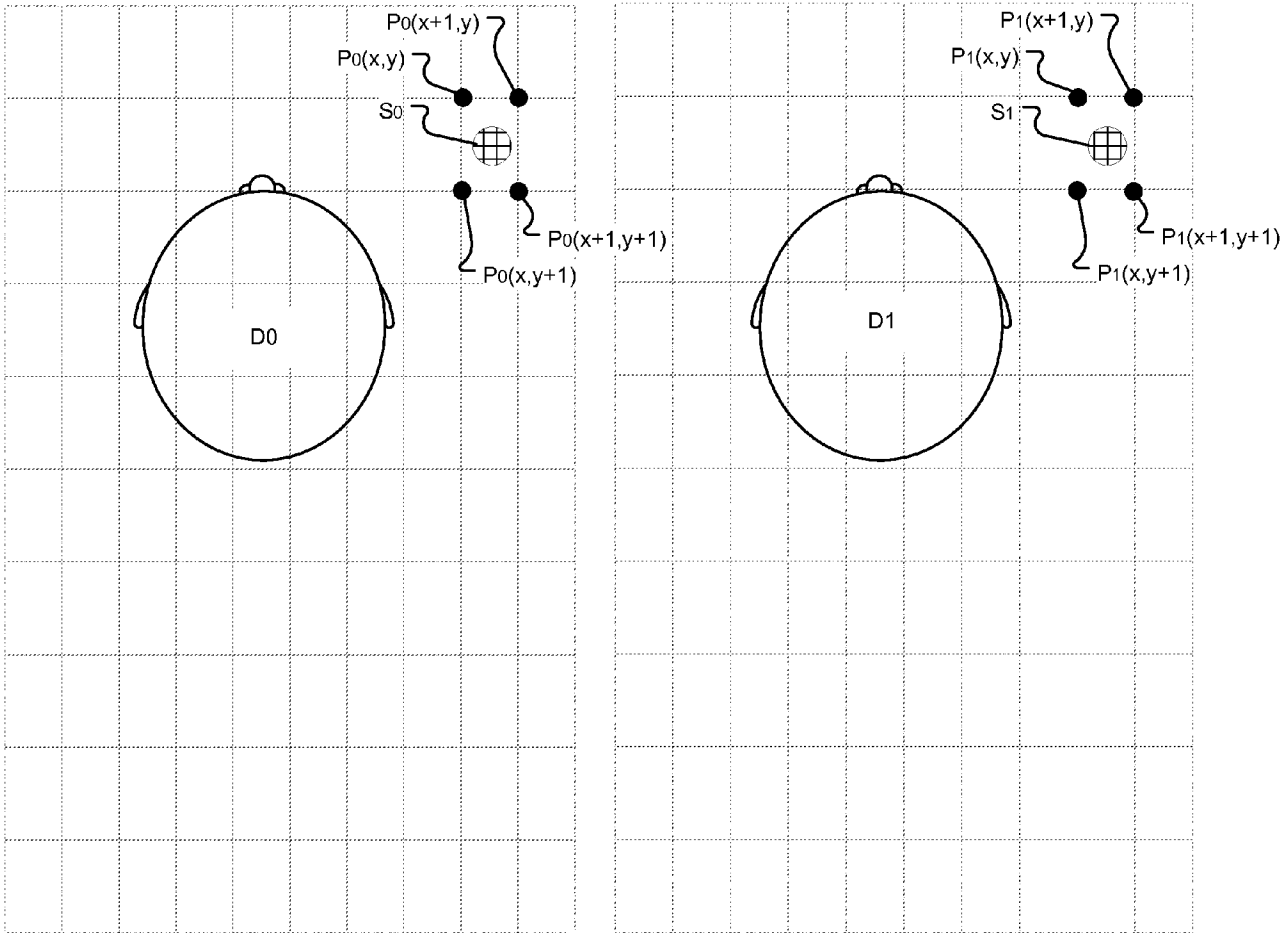
FIG. 3 is an illustrative diagram of a pair of grids defining corresponding acoustic areas of an audio system configured to simulate acoustic output at a location corresponding to source position data in each of the acoustic areas.

FIG. 3 depicts an example in which the listeners D0, D1 each hear an acoustic output projected from a location $S_0$, $S_1$, respectively. While these features of the present disclosure are described with reference to the specific location $S_0$, $S_1$, other alternative implementations generate acoustic output simulations from any location within the corresponding grid 102, 104 that forms the associated acoustic area.

In FIG. 3, example grid points $P_0$ (x,y), $P_0$ (x+1,y), $P_0$ (x,y+1), and $P_0$ (x+1, y+1) are the four closest grid points to the location $S_0$, and example grid points $P_1$(x,y), $P_1$ (x+1,y), $P_1$ (x,y+1), and $P_1$ (x+1, y+1) are the four closest grid points to the location $S_1$. In particular implementations, a magnitude adjusted linear sum of signal components of these four grid points is used to project the simulated acoustic output from the location $S_0$, $S_1$.

Figure 4:
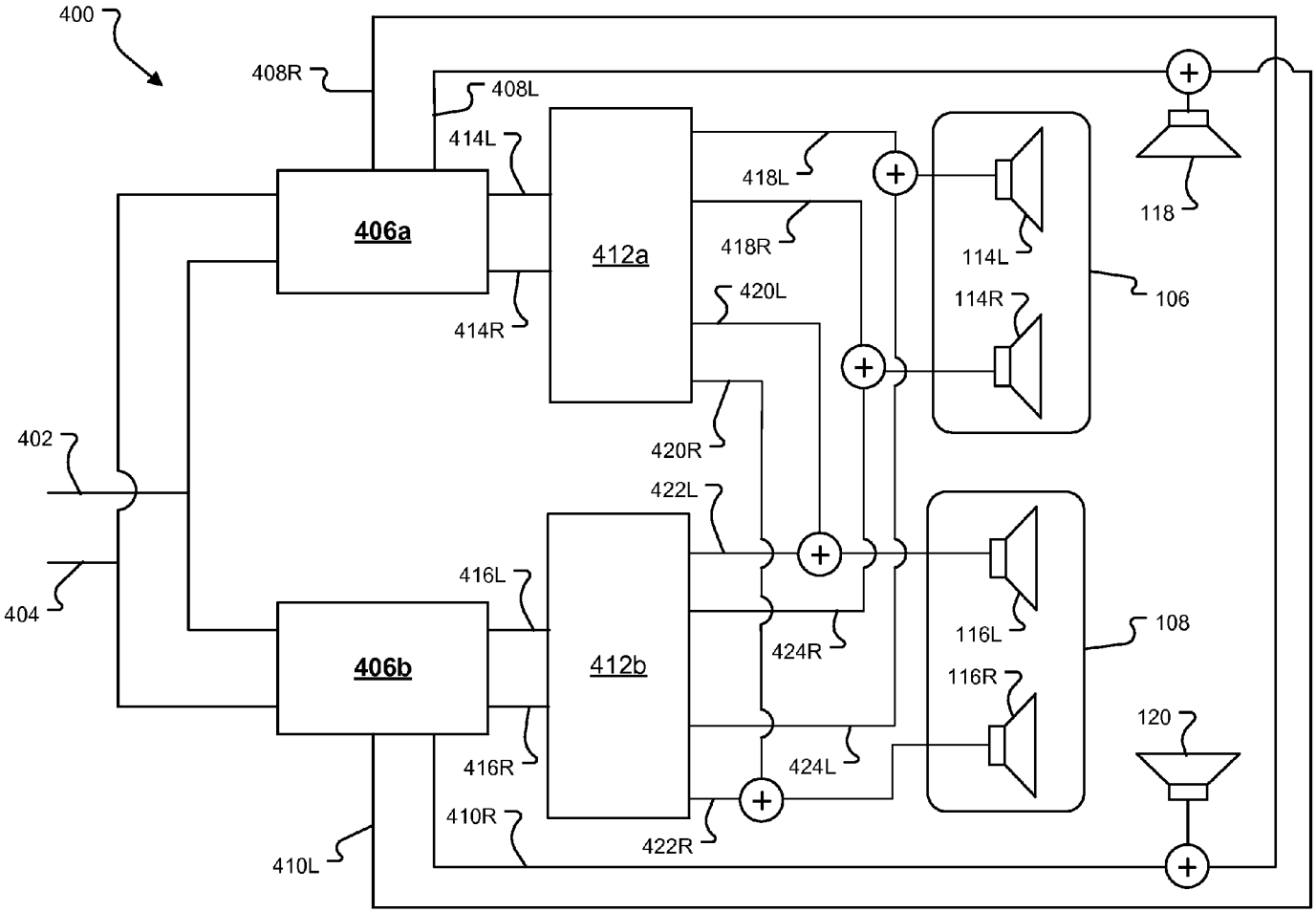
FIG. 4 is a schematic diagram of an audio system configured to simulate acoustic output at a location corresponding to source position data in each of a plurality of discrete acoustic areas.

FIG. 4 illustrates an exemplary audio system 400. An audio signal 402 and source position data 404 are provided to a pair of audio imaging modules 406*a*, 406*b* (collectively referenced as 406). The audio signal 402 may be non-entertainment announcement audio, such as automatic driver assistance system (ADAS) alerts, navigation alerts, and telephony audio. The source position data 404 may be provided from a user through manual input. Alternatively or additionally, the source position data may be determined automatically according to a predetermined set of rules depending on the source of the audio signal and/or the content. For example, the audio system may be configured such that audio announcement output from the vehicle's ADAS warning of an obstruction in the vehicle's rear left blind spot may by simulated in the rear left of the acoustic area. Navigation instructions to turn right ahead may be simulated as coming from a source at the front right of the vehicle compartment.

Each of the audio imaging modules 406*a*, 406*b* determines a set of speaker driver signals which cause the speakers 114, 116, 118, 120 to generate acoustic output that simulates output of the audio signal by an audio source at a particular location in each acoustic area. The particular location of the simulated audio source corresponds to the source position data.

Each set of speaker driver signals includes a pair of fixed speaker driver signals 408L, 408R, 410L, 410R for the left and right door speakers 118, 120. That is the first audio imaging module 406*a*, associated with the first acoustic area, provides fixed speaker driver signal 408L for the left door speaker, and fixed speaker driver signal 408R for the right door speaker. Similarly, the second audio imaging module 406*b*, associated with the second acoustic area, produces fixed speaker driver signals 410L, and 410R for the left and right door speakers, respectively. The fixed speaker driver signals 408L, 410L for the left door speaker 118 are combined and provided to the left door speaker 118. Similarly, the right speaker door signals 408R, 410L are combined and provided to the right door speaker 120.

The audio imaging modules 406*a*, 406*b* also provide headrest speaker driver signals to a pair of cross-talk cancellation filter blocks 412*a*, 412*b*. In that regard, the first audio imaging module 406*a* provides a first headrest speaker driver signal 414, shown as a stereo audio signal consisting of left and right audio channels 414L, 414R, to the first cross-talk cancellation filter block 412*a*; and the second audio imaging module 406*b* provides second headrest speaker driver signal 416, shown as a stereo audio signal consisting of left and right audio channels 416L, 416R, to the second cross-talk cancellation filter block 412*b*. The first headrest speaker driver signals 414L, 414R represent audio content for the first acoustic area, and the second headrest driver signals 416L, 416R represent audio content for the second acoustic area.

The filter blocks 412*a*, 412*b* filter the headrest speaker driver signals 414, 416 and provide filtered driver signals 418L, 418R, 420L, 420R, 422L, 422R, 424L, 424R to the headrest mounted speakers 114, 116. The filtering is designed to provide discrete listening zones at the different seat positions.

Figure 5:
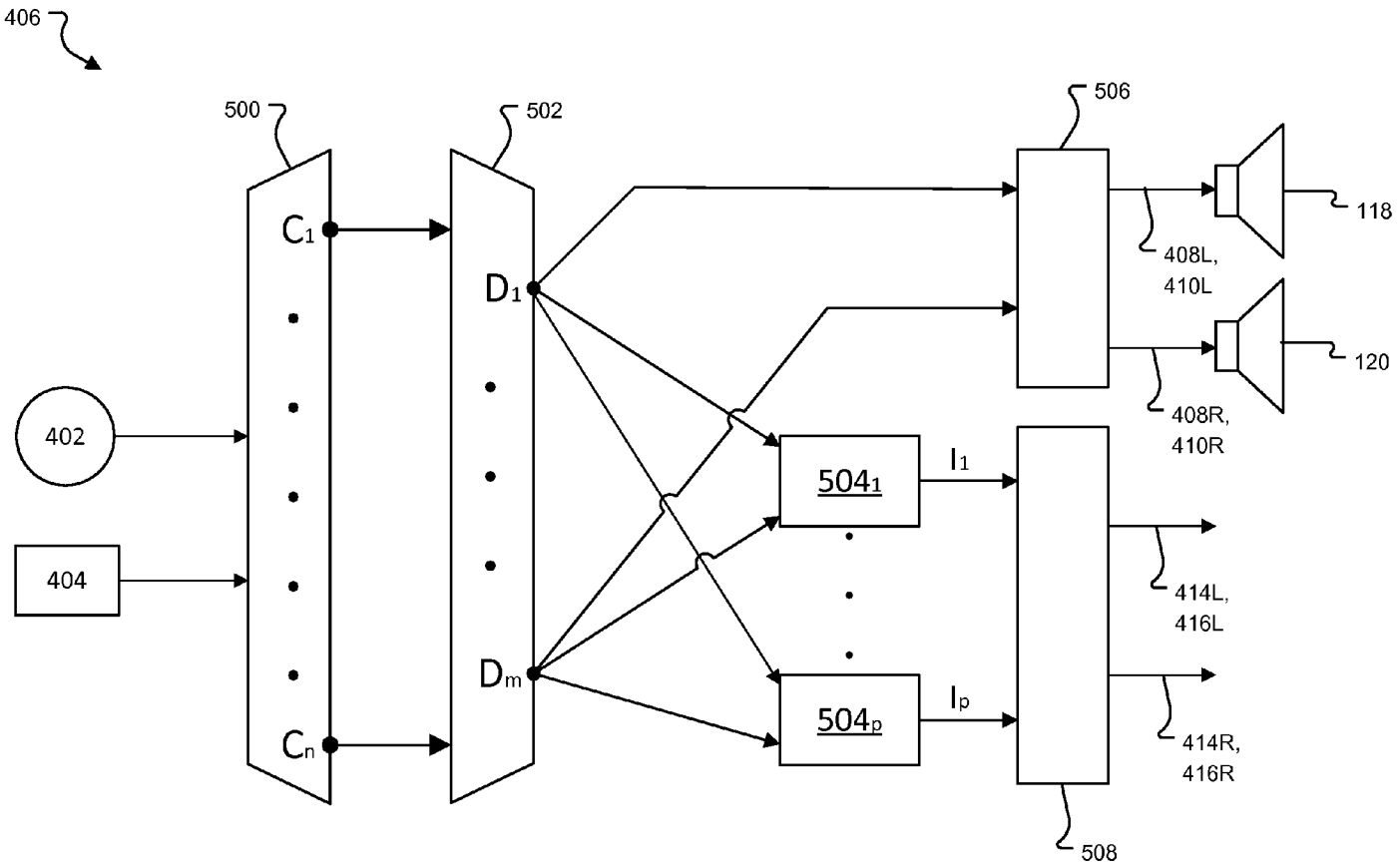
FIG. 5 is a schematic diagram of an audio imaging module from the audio system of FIG. 4.

FIG. 5 is diagram view of an audio imaging module 406. Each of the first and second imaging modules 406*a*, 406*b* can have this illustrated configuration. Referring to FIG. 5, the input audio signal 402 along with the source position data 404 is routed to an up-mixer module 500. In some aspects, the input audio signal 402 corresponds to a single channel (e.g., monaural) audio data. The audio up-mixer module 500 converts the input audio signal 402 into an intermediate number of components $C_1$-$C_n$, as shown. The intermediate components $C_1$-$C_n$ correspond to grid points on a corresponding one of the grids 102, 104 (FIG. 1) and are related to the different mapped locations from where the acoustic output is simulated. As used herein, the term "component" is used to refer to each of the intermediate directional assignments from where the original input audio signal 402 is up-mixed. In the example of the 10×10 grid 102, 104, there are 100 corresponding components, each of which corresponds to a particular one of the 10×10 grid points. In other examples, more or fewer grid points and intermediate components are used. It should be noted that any number of up-mixed components are possible, e.g., based on available processing power.

The up-mixer module 500 utilizes coordinates provided in the audio source position data to generate a vectors of n gains, which assign varying levels of the input audio signal to each of the up-mixed components $C_1$-$C_n$. Next, as shown in FIG. 5, the up-mixed intermediate components $C_1$-$C_n$ are down-mixed by an audio down-mixer module 502 into intermediate speaker signal components $D_1$-$D_m$, where m is the total number of speakers, including both real and virtual speakers.

Binaural filters $\mathbf{504}_1$-$\mathbf{504}_p$ then convert weighted sums of the intermediate speaker signal components $D_1$-$D_m$ into binaural image signals $I_1$-$I_p$, where p is the total number of virtual speakers. The binaural signals $I_1$-$I_p$ correspond to sound coming from the virtual speakers (e.g., speakers 202, 204, 206, 208, 210, 212; FIG. 2). While FIG. 5 shows each of the binaural filters $\mathbf{504}_1$-$\mathbf{504}_p$ receiving all of the intermediate speaker signal components, in practice, each virtual speaker will likely reproduce sounds from only a subset of the intermediate signal components $D_1$-$D_m$. Remixing stages 506 (only one shown) combine the intermediate speaker signal components to generate the fixed speaker driver signals (408L and 408R in the case of the first audio imaging module 406*a*, and 410L and 410R in the case of the second imaging module 406*b*) for delivery to the forward mounted fixed speakers 118, 120. A binaural mixing stage 508 combines the binaural image signals $I_1$-$I_p$ to generate the headrest speaker driver signals 414, 416.

Figure 6A:
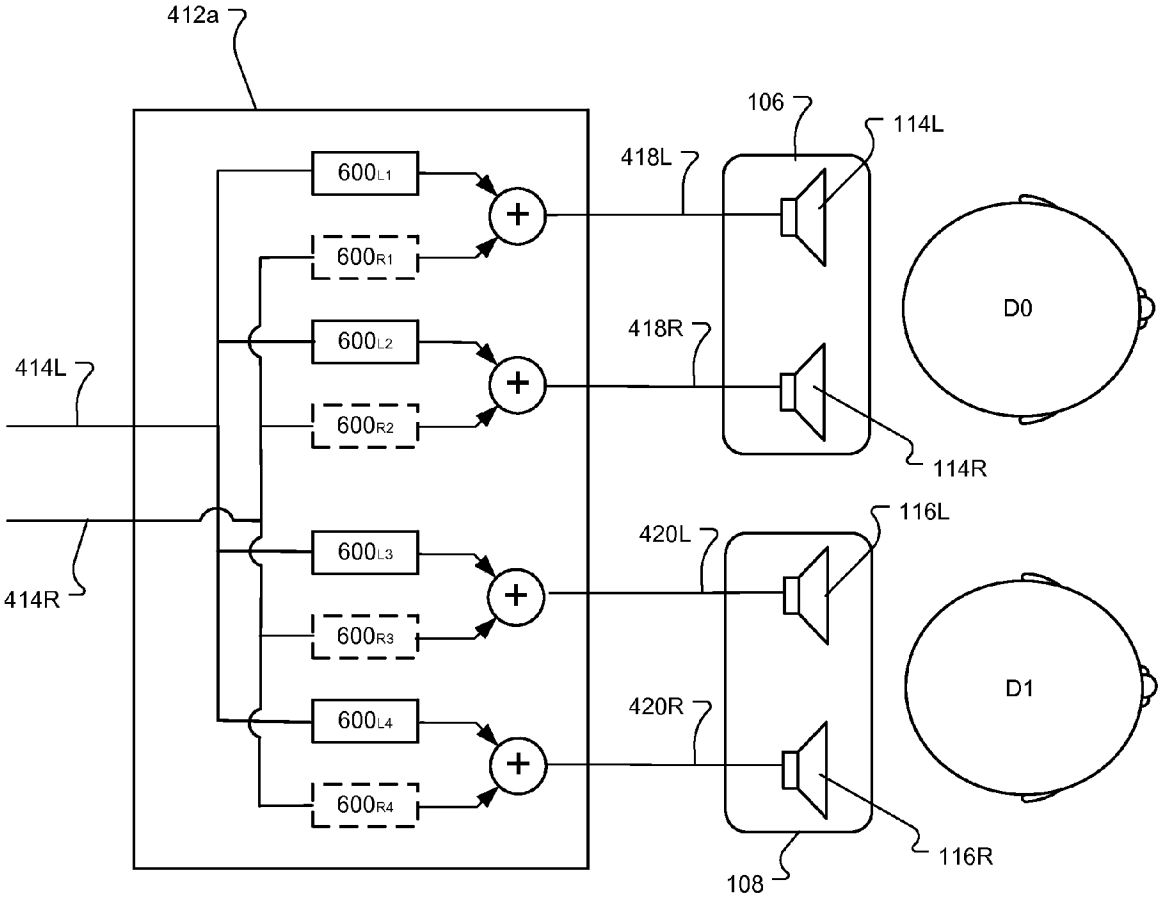
FIGS. 6A & 6B are schematic diagrams of first and second cross-talk cancellation filter block from the audio system of FIG. 4.

Referring to FIG. 6A, the first cross-talk cancellation filter block 412*a* includes a plurality of cross-talk cancellation filters (eight shown). The first headrest speaker driver signal 414, shown as a stereo audio signal consisting of left and right audio channels 414L, 414R, are passed through the first cross-talk cancellation filter block 412*a* to produce first filtered driver signals 418L, 418R, 420L, 420R, one for each of the headrest mounted speakers 114L, 114R, 116L, 116R. These filtered audio signals determine the net acoustic energy associated with each acoustic channel in the first headrest speaker driver signals that is provided to the occupants D0, D1.

A left channel filter $\mathbf{600}_{L1}$ associated with a left speaker 114L of the driver's headrest 106 modifies the left channel input 414L from the first headrest speaker driver signals taking into account the acoustic transfer functions from each of the other headrest mounted speakers 114R, 116L, 116R to an expected position of the driver's left ear to produce a first output signal component that is configured to reproduce the left channel acoustic content of the first headrest speaker driver signal 414 at the driver's left ear.

A right channel filter 600R1 associated with the left speaker 114L of the driver's headrest 106 modifies the right channel input 414R from the first headrest speaker driver signals taking into account the acoustic transfer functions from each of the other headrest mounted speakers 114R, 116L, 116R to the expected position of the driver's left ear to produce a second output signal component that is configured to cancel the right channel acoustic content of the first headrest speaker driver signal 414 that is leaked to the driver's left ear from the other speakers 114R, 116L, 116R in the headrests 106, 108.

The first and second output signal components are combined to produce a filtered driver signal 418L which is provided to the left speaker 114L in the driver's headrest 106. The remaining cross-talk cancellation filters of the first cross-talk cancellation filter block 412*a* and the associated speakers 114R, 116L, 116R operate similarly so that the driver D0 hears only left audio content of the first headrest speaker driver signal 414 at his/her left ear and hears only right audio content of the first headrest speaker driver signal 414 at his/her right ear.

Filters $\mathbf{600}_{L2}$ and $\mathbf{600}_{R2}$ provide a filtered driver signal 418R to the right speaker 114R in the driver's headrest 106, which is transduced to reproduce the right channel acoustic content of the first headrest speaker driver signal 414 at the driver's right ear, while cancelling left channel content of the first headrest speaker driver signal 414 leaked by the other headrest mounted speakers 114L, 116L, 116R at the driver's right ear.

Filters $\mathbf{600}_{L3}$ and $\mathbf{600}_{R3}$ provide a filtered driver signal 420L to the left speaker 116L in the passenger's headrest 108, which is transduced to cancel left and right channel content of the first headrest speaker driver signal 414 leaked by the other headrest mounted speakers 114L, 114R, 116R at the passenger's left ear.

Filters $\mathbf{600}_{L4}$ and $\mathbf{600}_{R4}$ provide a filtered driver signal 420R to the right speaker 116R in the passenger's headrest 108, which is transduced to cancel the left and right channel content of the first headrest speaker driver signal 414 leaked by the other headrest mounted speakers 114L, 114R, 116L at the passenger's right ear.

Figure 6B:
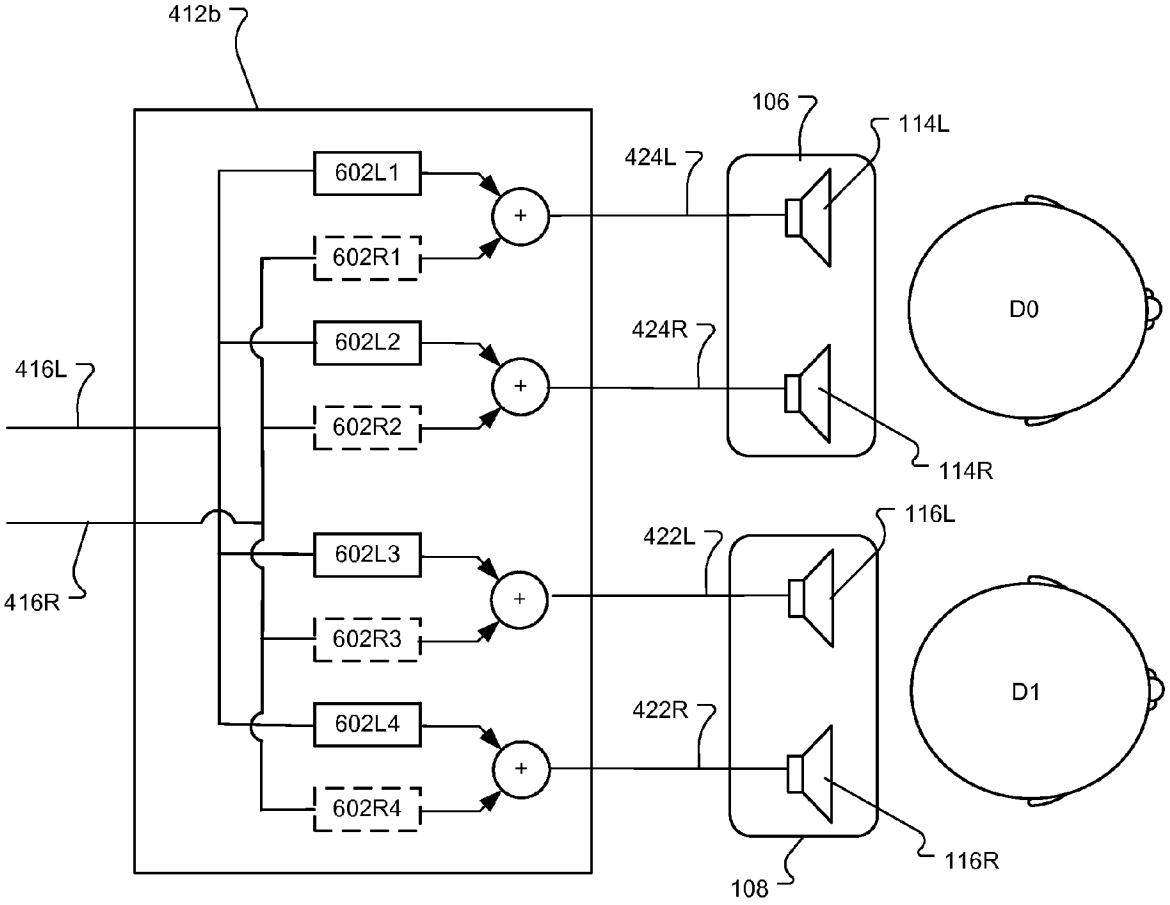

Referring to FIG. 6B, the second cross-talk cancellation filter block 412*b* includes a plurality of cross-talk cancellation filters (eight shown). The second headrest speaker driver signal 416, shown as a stereo audio signal consisting of left and right audio channels 416L, 416R is passed through the second cross-talk cancellation filter block 412*b* to produce second filtered driver signals 422L, 422R, 424L, 424R, one for each of the headrest mounted speakers 114L, 114R, 116L, 116R. These filtered driver signals 422L, 422R, 424L, 424R determine the net acoustic energy associated with each acoustic channel in the second headrest speaker driver signal 416 that is provided to the seat occupants D0, D1.

A left channel filter $\mathbf{602}_{L1}$ associated with the left speaker 114L of the driver's headrest 106 modifies the left channel input 416L from the second headrest speaker driver signal 416 taking into account the acoustic transfer functions from each of the other headrest mounted speakers 114R, 116L, 116R to an expected position of the driver's left ear to produce a filtered driver signal 424L that is configured to cancel the left channel acoustic content of the second headrest speaker driver signal 416 that is leaked to the driver's left ear from the other headrest mounted speakers 114R, 116L, 116R.

A right channel filter $\mathbf{602}_{R1}$ associated with the driver's headrest 106 modifies the right channel input signal 416R from the second headrest speaker driver signal 416 taking into account the acoustic transfer functions from each of the other front headrest mounted speakers 114R, 116L, 116R to the expected position of the driver's left ear to produce a second output signal component that is configured to cancel the right channel acoustic content of the second headrest speaker driver signal 416 that is leaked to the driver's left ear from the other front headrest mounted speakers 114R, 116L, 116R. The first and second output signal components are combined to produce a filtered audio signal 424L which is provided to the left speaker 114L in the driver's headrest 106.

Filters $\mathbf{602}_{L2}$ and $\mathbf{602}_{R2}$ provide a filtered driver signal 424R to the right speaker 114R in the driver's headrest 106, which is transduced to cancel audio content of the second headrest speaker driver signal 416 leaked by the other headrest mounted speakers 114L, 116L, 116R at the driver's right ear.

Filters $\mathbf{602}_{L3}$ and $\mathbf{603}_{R3}$ provide a filtered driver signal 422L to the left speaker 116L in the passenger's headrest 108, which is transduced to reproduce the left channel acoustic content of the second headrest speaker driver signal 116 at the passenger's left ear, while cancelling right channel content of the second headrest speaker driver signal 116 leaked by the other headrest mounted speakers 114L, 114R, 116R at the passenger's left ear.

Filters $\mathbf{602}_{L4}$ and $\mathbf{602}_{R4}$ provide a filtered driver signal 422R to the right speaker 116R in the passenger's headrest 108, which is transduced to reproduce the right channel acoustic content of the second headrest speaker driver signal 416 at the passenger's right ear, while cancelling left channel content of the second headrest speaker driver signal 416 leaked by the other headrest mounted speakers 114L, 116L, 116R at the passenger's right ear.

Acoustic energy from the headrest mounted speakers 114L, 114R in the driver's headrest 106 combines with acoustic energy from the other fixed speakers 118, 120 to simulate output of the audio signal by an audio source at a location corresponding to the source position data in the first grid 102—the acoustic area associated with the driver D0. Acoustic energy from the headrest mounted speakers 116L, 116R in the passenger's headrest 108 combines with acoustic energy from the other fixed speakers 118, 120 to simulate output of the audio signal by an audio source at a location corresponding to the source position data in the second one of the acoustic areas.

In some implementations, the audio system is configured to enable a privacy mode(s) which allow a user to turn off the audio imaging in their acoustic area. The privacy mode leverages the crosstalk cancellation described above to provide energy to one listener and reduced energy at opposite seating location. In privacy mode, the audio system discards any source position data in favor of simulating an audio source a predetermined point on the grid that utilizes audio from the headrest mounted speakers only (i.e., the forward mounted fixed speakers are not used as they would likely transmit energy to the listener that has engaged the privacy mode). The predetermined position is selected to minimize the amount of acoustic energy that is transmitted to the other listener (i.e., the listener that engaged the privacy mode).

Figure 7:
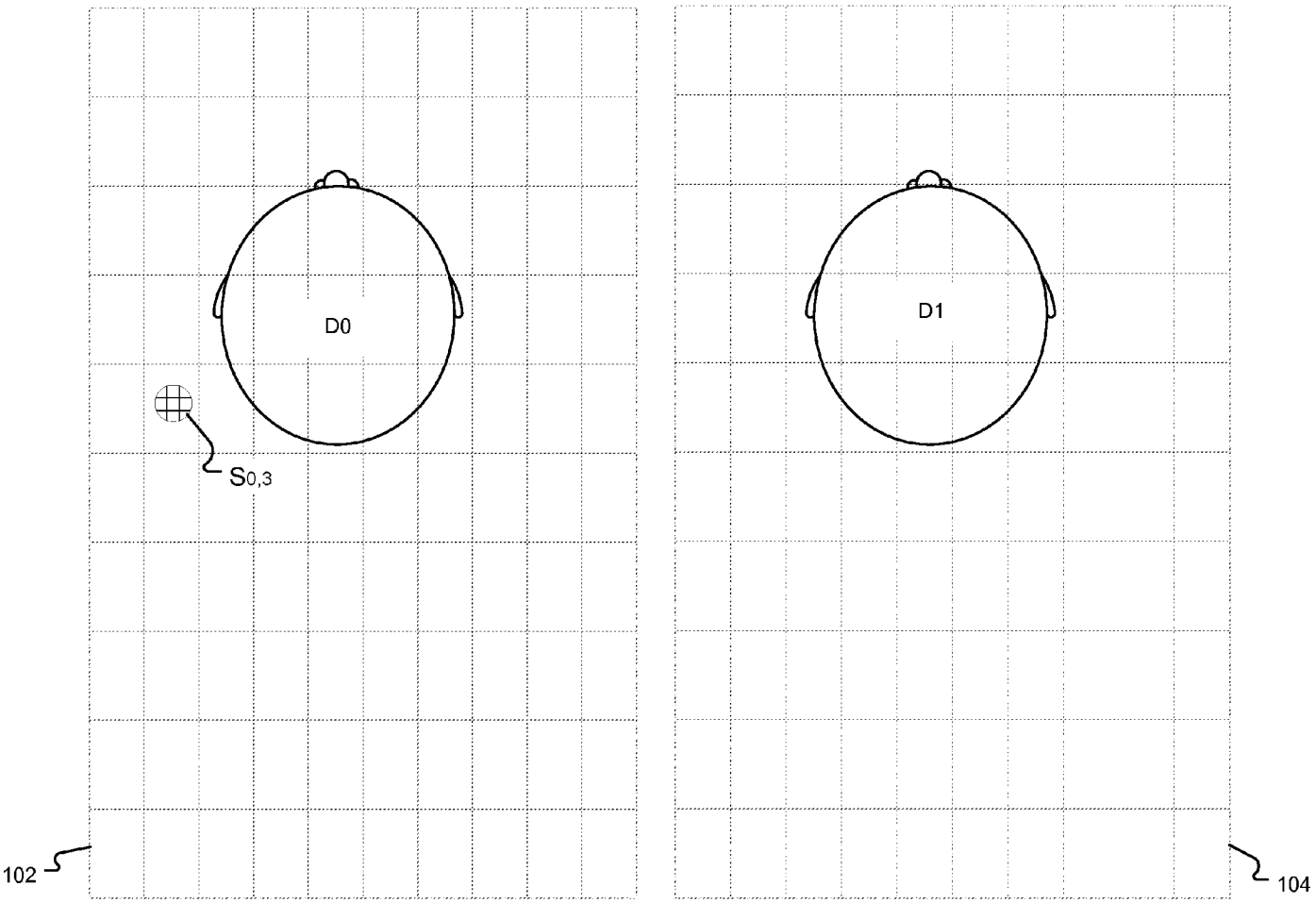
FIG. 7 is a diagram illustrating a first privacy mode of an audio system configured to simulate acoustic output at a location corresponding to source position data in each of a plurality of discrete acoustic areas.

FIG. 7 illustrates a situation in which the passenger has elected to engage the privacy mode (a first, passenger privacy mode). In this situation, the audio system utilizes the speakers in the driver's headrest to place a simulated acoustic source $S_{0,3}$ near the outboard (left) ear of the of the driver D0. The positioning of the acoustic image substantially attenuates (e.g., minimizes) the energy that is transmitted to the passenger D1, and, since the fixed speakers are not used when the system is operating in the privacy mode, the passenger D1 is not disturbed by acoustic energy transmitted from those speakers. The utilization of cross-talk cancellation, as described above with reference to FIGS. 6A & 6B further limits acoustic energy at the passenger's ears.

Figure 8:
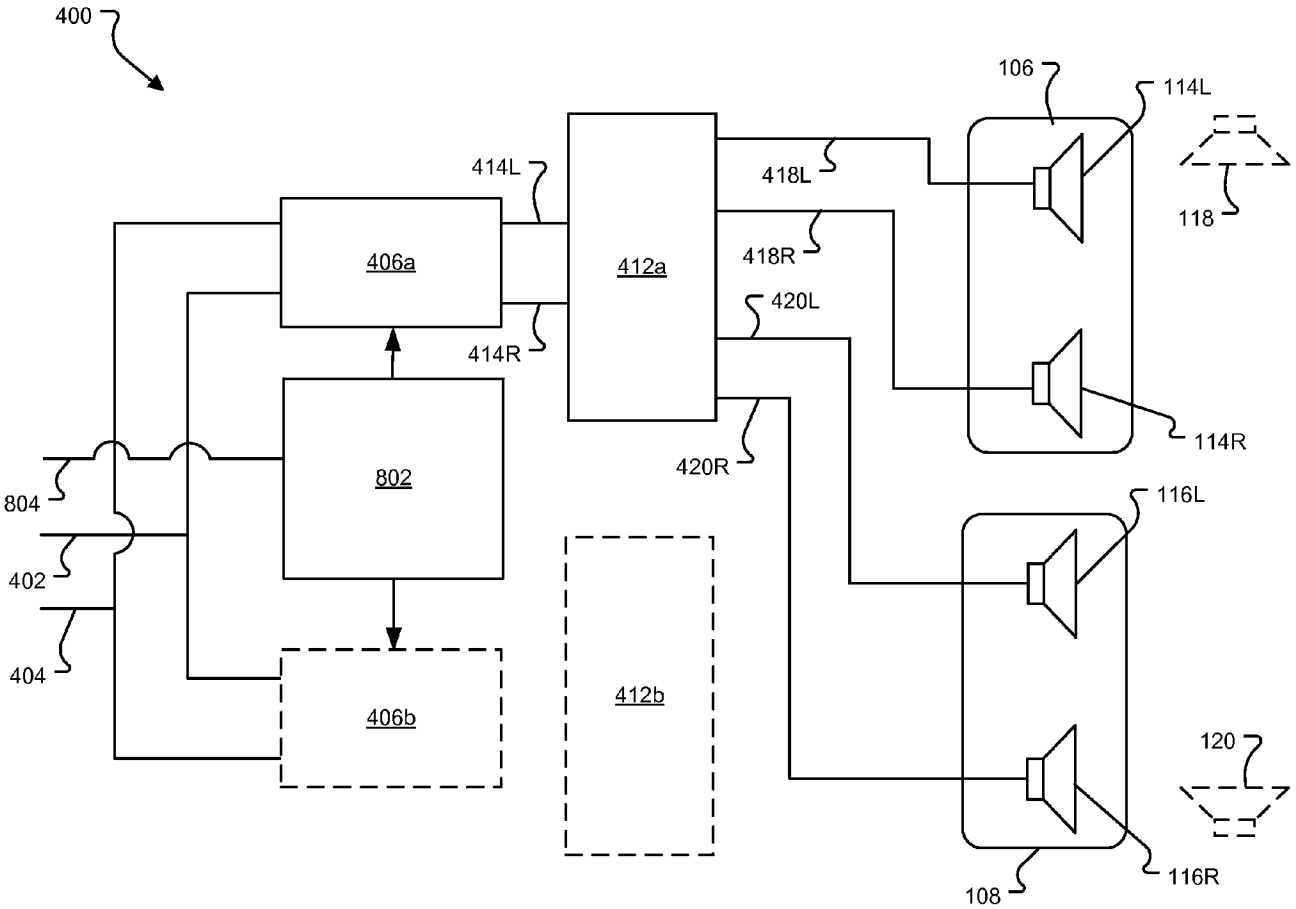
FIG. 8 is a schematic diagram of an audio system configured to enable the privacy mode of FIG. 7.

FIG. 8 illustrates an example of the audio system 400 implementing the privacy mode of FIG. 7. Notably, the audio system includes a privacy mode control module 802 which is configured to receive user input 804 indicating engagement of the privacy mode by one of the listeners. The user input may be provided via user interface in the vehicle compartment. In response to receiving user (e.g., passenger) input 804 engaging the first privacy mode, the privacy mode control module 802 deactivates the audio imagining module associated with the engaging user's acoustic area. FIG. 8 illustrates a situation in which the passenger D1 has engaged the first privacy mode. In response, the privacy mode control module 802 deactivates the second acoustic imaging module 406*b* (as indicated by dashed lines), thereby switching off the speaker driver signal to the passenger's virtual speakers and, thus, terminating input to the second cross-talk cancellation block 412*b*.

As a response to the passenger's engagement of the first privacy mode, the privacy mode control module 802 also causes the first audio imaging module 406*a* to disregard audio source position input 404 and instead use predetermined location data to position the simulated acoustic source at a predetermined location (e.g., near the left ear of the driver) within the first grid 102. The predetermined location data may be stored in memory accessible to the privacy mode control module 802 and/or the first audio imaging module 406*a*. The positioning of the simulated acoustic source at this predetermined location utilizes only the speakers in the driver's headrest. Consequently, no speaker driver signals are provided to the left and right door speakers 118, 120 when the system 100 is operating in the first privacy mode.

The first audio imaging module 406*a* continues to provide a headrest speaker driver signal 414, shown as a stereo audio signal consisting of left and right audio channels 414L, 414R, to the first cross-talk cancellation block 412*a*, which functions as described above to provide filtered driver signals 418L, 418R to the speakers in the driver's headrest 106 to simulate the acoustic source at the predetermined location. The first cross-talk cancellation filter block 412*a* also continued to provide filtered driver signals 420L, 420R to the speakers in the passenger's headrest 108 to cancel acoustic energy transmitted from the speakers 114L, 114R in the driver's headrest 106 at the passenger's ears.

Figure 9:
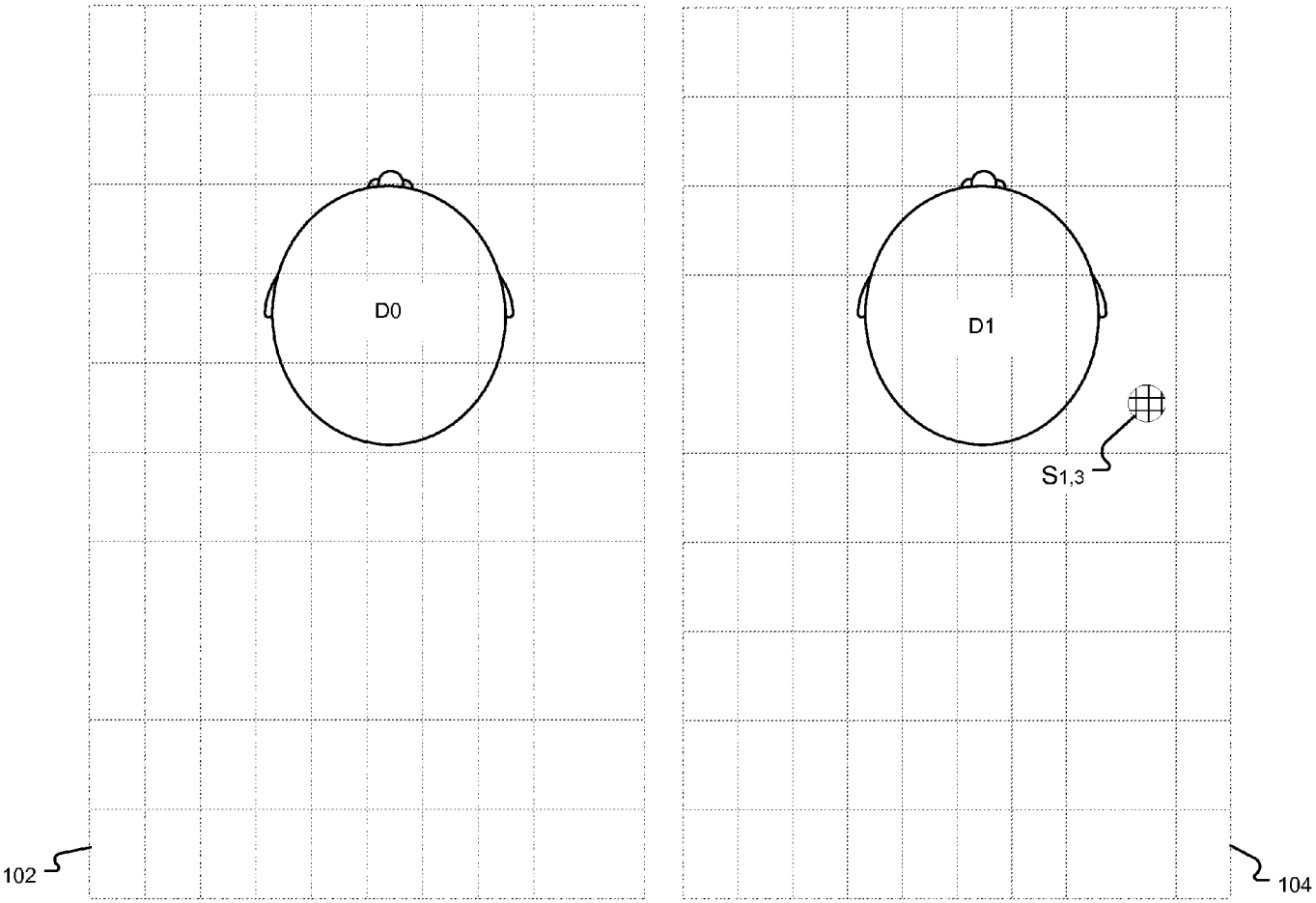
FIG. 9 is a diagram illustrating a first privacy mode of an audio system configured to simulate acoustic output at a location corresponding to source position data in each of a plurality of discrete acoustic areas.
Figure 10:
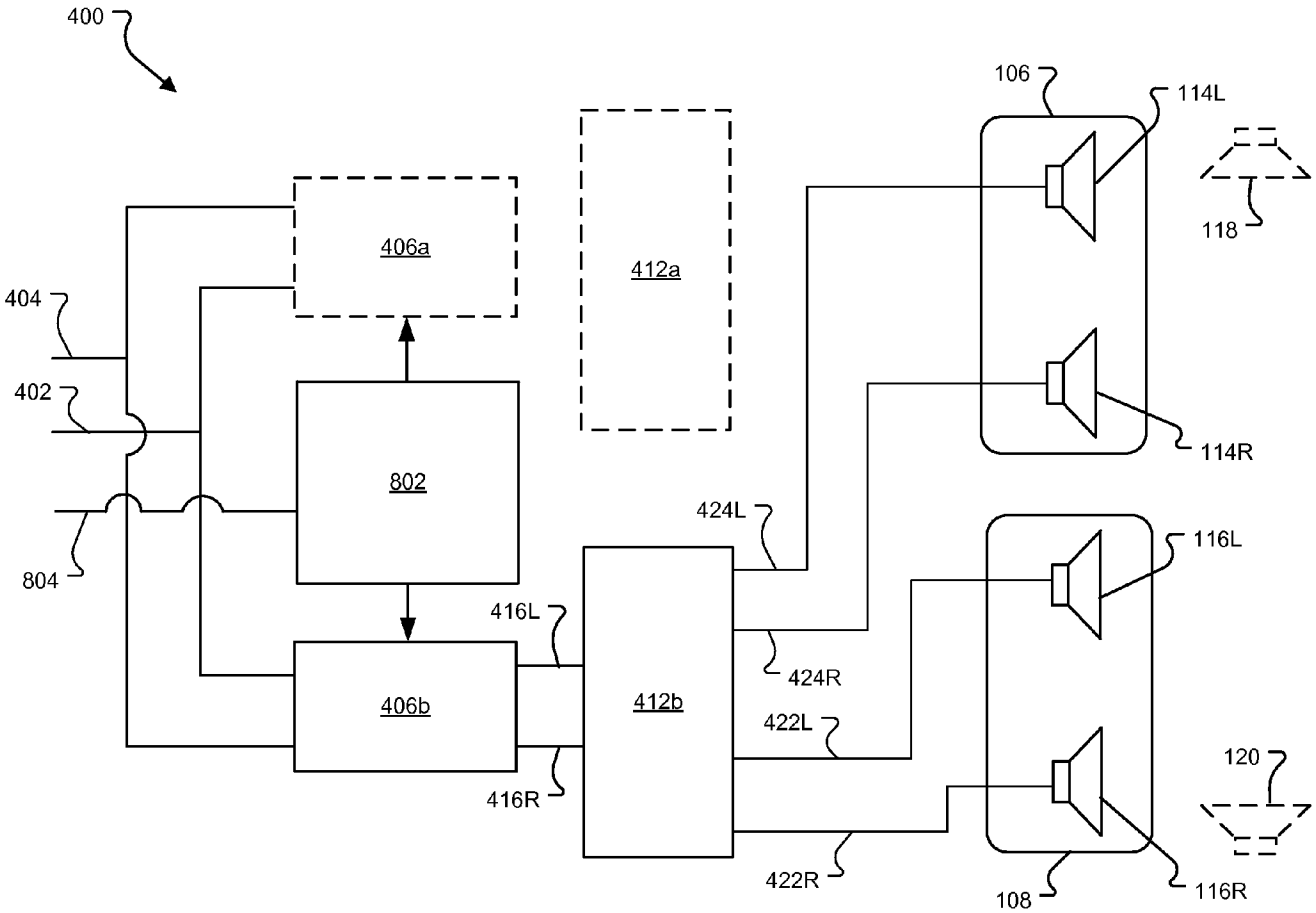
FIG. 10 is a schematic diagram of an audio system configured to enable the privacy mode of FIG. 9.

FIGS. 9 and 10 illustrate a complementary, second privacy mode for the driver D0. Referring to FIG. 9, the audio system utilizes the speakers 116L, 116R in the passenger's headrest 108 to place a simulated acoustic source $S_{1,3}$ near the outboard (right) ear of the of the passenger D1. The positioning of the acoustic image at this location reduces the energy that is transmitted to the driver D0, and, since the fixed speakers 118, 120 are also not used when the system is operating in this second privacy mode, the driver D0 is not disturbed by acoustic energy transmitted from those forward mounted fixed speakers 118, 120. The utilization of cross-talk cancellation further limits acoustic energy at the driver's ears.

FIG. 10 illustrates a state of the acoustic system 400 when the driver has engaged the second privacy mode. The privacy mode control module 802 receives the user input 804 indicating engagement of the second privacy mode, and, in response, deactivates the first acoustic imaging module 406*a*, thereby switching off the speaker driver signal 414 to the driver's virtual speakers and, thus, terminating input to the first cross-talk cancellation block 412*a*.

In response to receiving user input indicating engagement of the second privacy mode, the privacy mode control module 802 also causes the second audio imaging module 406*b* to disregard audio source position input 404 and instead use predetermined location data to position the simulated acoustic source (a/k/a the "acoustic image") at a second predetermined location (e.g., near the right (outboard) ear of the passenger) within the second grid 104 (FIG. 1). The positioning of the simulated acoustic source at this second predetermined location utilizes the only the speakers 116L, 116R in the passenger's headrest 108. As a result, no speaker driver signals are provided to the left and right door speakers 118, 120 when the system is operating in this second privacy mode.

The second audio imaging module 406*b* continues to provide a headrest speaker driver signal 416, shown as a stereo audio signal consisting of left and right audio channels 416L, 416R, to the second cross-talk cancellation block 412*b*, which functions as described above to provide filtered driver signals 422L, 422R to the speakers 116L, 116R in the passenger's headrest 108 to simulate the acoustic source at the second predetermined location, and provides filtered driver signals 424L, 424R to the speakers 114L, 114R in the driver's headrest 106 to cancel acoustic energy transmitted from the speakers 116L, 116R in the passenger's headrest at the driver's ears.

While examples have been discussed in which headrest mounted speakers are utilized, in combination with binaural filtering, to provide virtualized speakers, in some cases, the speakers may be located elsewhere in proximity to an intended position of a listener's head, such as in the vehicle's headliner, visors, or in the vehicle's B-pillars. Such speakers are referred to generally as "near-field speakers."

A number of implementations have been described. Nevertheless, it will be understood that additional modifications may be made without departing from the scope of the inventive concepts described herein, and, accordingly, other implementations are within the scope of the following claims.

What is claimed is:

1. An audio system comprising:

a plurality of speakers; and an audio signal processor configured to:

receive an audio signal and source position data associated with the audio signal; and apply a set of speaker driver signals to the plurality of speakers, wherein the set of speaker driver signals causes the plurality of speakers to generate acoustic output that simulates output of the audio signal at respective specific and discrete locations corresponding to the source position data in each of a plurality of discrete acoustic areas in an acoustic space and is not limited to respective locations corresponding to the plurality of speakers, wherein the audio signal processor is configured to receive user input indicating engagement of a privacy mode, and, in response, halt the simulation of output of the audio signal in a first one of the acoustic areas.

2. The audio system of claim 1, wherein, in response to receiving the user input indicating engagement of the privacy mode, the audio signal processor is configured to override the received source position data with predetermined position data, such that output of the audio signal is simulated at a location corresponding to the predetermined position data in a second one of the acoustic areas.

3. The audio system of claim 2, wherein the audio signal processor is configured to provide for crosstalk cancellation filtering of the speaker driver signals for crosstalk cancellation between the first and second ones of the acoustic areas, and wherein the predetermined position data corresponds to a location in the second one of the acoustic areas in which crosstalk is substantially attenuated relative to the first one of the acoustic areas.

4. The audio system of claim 1, wherein the audio signal processor is further configured to filter a subset of the speaker driver signals via a plurality of cross-talk cancellation filters before the subset of speaker driver signals are applied to a corresponding subset of the speakers, thereby to inhibit cross-talk of acoustic energy between the plurality of acoustic areas.

5. The audio system of claim 1, wherein the plurality of speakers comprise:

a first plurality of near-field speakers arranged in a first one of the acoustic areas;

a second plurality of near-field speakers arranged in a second one of the acoustic areas; and a plurality of other fixed speakers, wherein the audio system is configured such that acoustic energy from the first plurality of near-field speakers combines with acoustic energy from the other fixed speakers to simulate output of the audio signal at the location corresponding to the source position data when the location is in the first one of the acoustic areas, and such that acoustic energy from the second plurality of near-field speakers combines with acoustic energy from the other fixed speakers to simulate output of the audio signal at the location corresponding to the source position data when the location is in the second one of the acoustic areas.

6. The audio system of claim 5, further comprising a plurality of headrests, wherein the near-field speakers are mounted in the headrests.

7. The audio system of claim 1, wherein the plurality of speakers and the audio signal processor are included in a vehicle.

8. A method comprising:

receiving an audio signal and source position data associated with the audio signal; and applying a set of speaker driver signals to a plurality of speakers, wherein the set of speaker driver signals causes the plurality of speakers to generate acoustic output that simulates output of the audio signal at respective specific and discrete locations corresponding to the source position data in each of a plurality of discrete acoustic areas in an acoustic space and is not limited to respective location corresponding to the plurality of speakers; and receiving input indicating engagement of a privacy mode, and, in response, halting the simulation of output of the audio signal in a first one of the plurality of acoustic areas.

9. The method of claim 8, wherein the set of speaker driver signals are applied to one or more fixed speakers, one or more virtual speakers, or a combination thereof.

10. The method of claim 8, wherein halting the simulation of output of the audio signal in a first one of the plurality of acoustic areas comprises ceasing to apply a subset of the speaker driver signals to the plurality of speakers.

11. The method of claim 8, further comprising, in response to receiving the input indicating engagement of the privacy mode, overriding the received source position data with predetermined position data, such that output of the audio signal is simulated at a location corresponding to the predetermined position data in a second one of the acoustic areas.

12. The method of claim 11, wherein the predetermined position data corresponds to a location in the second one of the acoustic areas in which crosstalk is substantially attenuated relative to the first one of the acoustic areas.

13. The method of claim 12, further comprising providing crosstalk cancellation filtering of the speaker driver signals for crosstalk cancellation between the first and second ones of the acoustic areas.

14. The method of claim 8, further comprising filtering a subset of the speaker driver signals via a plurality of cross-talk cancellation filters before applying the subset of speaker driver signals to a corresponding subset of the speakers, thereby inhibiting cross-talk of acoustic energy between the plurality of acoustic areas.

15. A non-transitory machine-readable storage medium having instructions stored thereon to simulate acoustic output, which, when executed by a processor, cause the processor to:

receive an audio signal and source position data associated with the audio signal;

apply a set of speaker driver signals to a plurality of speakers, wherein the set of speaker driver signals causes the plurality of speakers to generate acoustic output that simulates output of the audio signal at respective specific and discrete locations corresponding to the source position data in each of a plurality of discrete acoustic areas in an acoustic space and is not limited to respective location corresponding to the plurality of speakers; and receive user input indicating engagement of a privacy mode, and, in response, halt the simulation of output of the audio signal in a first one of the acoustic areas.

16. The non-transitory machine-readable storage medium of claim 15, wherein the instructions cause the processor to, in response to receiving the user input indicating engagement of the privacy mode, override the received source position data with predetermined position data, such that output of the audio signal is simulated at a location corresponding to the predetermined position data in a second one of the acoustic areas.

17. The non-transitory machine-readable storage medium of claim 16, wherein the predetermined position data corresponds to a location in the second one of the acoustic areas in which crosstalk is substantially attenuated relative to the first one of the acoustic areas.

18. The non-transitory machine-readable storage medium of claim 17, wherein the instructions further cause the processor to provide for crosstalk cancellation filtering of the speaker driver signals for crosstalk cancellation between the first and second ones of the acoustic areas.

* * * * *